US005392851A

United States Patent [19]

Arend

[11] Patent Number: 5,392,851

[45] Date of Patent: Feb. 28, 1995

[54] WIRELINE CABLE HEAD FOR USE IN COILED TUBING OPERATIONS

[75] Inventor: Nicholas J. Arend, Manville, Tex.

[73] Assignee: Western Atlas International, Inc., Houston, Tex.

[21] Appl. No.: 259,488

[22] Filed: Jun. 14, 1994

[51] Int. Cl.[6] ..... E21B 19/22; E21B 33/072; E21B 23/00; E21B 34/00

[52] U.S. Cl. ..... 166/65.1; 166/384; 166/385; 166/50; 166/325

[58] Field of Search ..... 166/65.1, 385, 384, 166/243, 77, 50, 325, 386, 241.5

[56] References Cited

U.S. PATENT DOCUMENTS 4,577,687 3/1986 Lanmor, II ..... 166/385
4,862,958 9/1989 Pringle ..... 166/385
5,141,051 8/1992 Lenhart ..... 166/65.1

*Primary Examiner*—Stephen J. Novosad
*Attorney, Agent, or Firm*—E. Eugene Thigpen

[57] ABSTRACT

The invention is a wireline cable head adapted to be used on a wireline tool string which is conveyed into a wellbore by a coiled tubing. The cable head comprises a biased, piston-type check valve which enables fluid circulation from the tubing into the wellbore, but prevents fluid flow from the wellbore into the coiled tubing. The biasing means maintains a minimum differential pressure which must be pumped into the coiled tubing to enable fluid circulation from the coiled tubing into the wellbore. The cable head also comprises a bulkhead for maintaining hydraulic integrity of the cable head after the cable is extracted from the cable head.

4 Claims, 4 Drawing Sheets

WIRELINE CABLE HEAD FOR USE IN COILED TUBING OPERATIONS

BACKGROUND OF THE INVENTION

1. Field of the Invention

The present invention is related to the field of servicing wellbores with electric wireline tools. More specifically, the present invention is related to the use of electric wireline tools which are conveyed into a wellbore by using coiled tubing. Coiled tubing is typically used to transport servicing tools, including electric wireline tools, into wellbores which are directionally drilled to high inclinations.

2. Description of the Related Art

Coiled tubing conveyance of servicing tools, including electric wireline tools, into wellbores, is known in the art. For example, "World Oil's Coiled Tubing Handbook", Gulf Publishing Co., Houston, Tex., 1993, describes a number of the applications of coiled tubing for servicing wellbores.

To convey electric wireline tools into a wellbore with coiled tubing, it is first necessary to insert an electric wireline, or cable, coaxially into the coiled tubing. After insertion of the cable into the coiled tubing, one end of the cable is connected to a cable head, which makes electrical and mechanical connections from the cable to the electric wireline tools. The cable head is affixed to the coiled tubing in such a way that the motion of the coiled tubing as it traverses the wellbore is transmitted to the electric wireline tools, or tool string, directly through the cable head and not through the cable itself.

A pump which circulates fluid from the earth's surface, through the coiled tubing and into the wellbore is typically required for servicing a wellbore with coiled tubing. Circulation of fluid into the wellbore can be used for such purposes as cleaning the wellbore of drilling debris, and maintaining control of fluid pressure in the wellbore particularly in cases where the wellbore may penetrate an earth formation with a fluid pressure which exceeds the hydrostatic pressure of the fluid in the wellbore. Maintaining control of fluid pressure in the wellbore requires the ability to seal the wellbore in the event of pump failure or a leak in the coiled tubing which would make using the pump impossible.

Safety considerations require that the annular space between the exterior of the coiled tubing and the interior of the wellbore be sealable at or near the earth's surface to prevent uncontrolled escape of fluid from the wellbore through the annular space. Safety considerations also require that the coiled tubing be hydraulically sealed. Uncontrolled fluid escape from the wellbore, known as a "blowout", can be caused by penetrating an earth formation with a fluid pressure which exceeds the hydrostatic pressure of fluid in the wellbore if the annular space and the coiled tubing are not hydraulically sealed. An annular seal is typically attached to a casing flange at the top of the wellbore for sealing annular space to prevent a blowout.

The hydraulic seal in the coiled tubing can be lost if the tubing develops a leak above the annular seal. In the case of a leak in the tubing above the annular seal, equipment attached to the top of the wellbore, which typically includes a set of hydraulically operated rams, can completely close the wellbore. Closure is achieved by severing any device passing through the rams, which can include the coiled tubing. After severing the device, the rams themselves close to seal the wellbore.

Using the rams with coiled tubing in the wellbore is not desirable because the coiled tubing would be severed if the rams were closed. Severed coiled tubing is very difficult to recover from the wellbore, since a drilling rig, or similar system with vertical lifting capability, will typically not be in use at the wellbore when the wellbore is being serviced with coiled tubing.

It is known in the art to use a one way flow or "check" valve to supplement the rams and the annular seal for preventing uncontrolled fluid discharge from the wellbore. The check valve is typically attached to the end of the coiled tubing which is inserted in the wellbore. The check valve prevents fluid entry into the coiled tubing from the wellbore. In the event the wellbore penetrates a formation with a fluid pressure which exceeds the hydrostatic pressure of the fluid in the wellbore, the check valve could prevent a blowout, particularly if the coiled tubing were to develop a leak above the annular seal. Because the fluid in the wellbore is prevented from entering the coiled tubing by the check valve, the annular seal alone can usually seal the wellbore in the event of a leak in the coiled tubing located above the annular seal.

It is also known in the art to use a check valve in combination with a cable head adapted to be affixed to the end of the coiled tubing. The check valve known in the art typically comprises a spring loaded ball and a substantially conically shaped valve seat machined into the cable head. The ball is pushed into the valve seat by the spring. The check valve known in the art has problems during repeated operation. Fluids pumped through the coiled tubing can contain materials which deposit on the valve seat and cause the check valve to lose sealing capability.

It is an object of the present invention to provide a wireline cable head, adapted to be affixed to one end of a coiled tubing, the cable head having a check valve that is resistant to seal loss.

SUMMARY OF THE INVENTION

The invention is a cable head used for conveyance of wireline tools by a coiled tubing into a wellbore penetrating an earth formation. The cable head has, affixed to one end of the coiled tubing, a housing which comprises a check valve and at least one fluid discharge hole in fluid communication with the wellbore. The check valve comprises a piston in fluid communication at one end with the interior of the coiled tubing and at the other end in fluid communication with the wellbore, and biasing means for pushing the piston to seal the at least one discharge hole when the pressure inside the coiled tubing is less than the pressure inside the wellbore plus the bias pressure. The cable head also comprises a sealed bulkhead, which enables the cable to be extracted from the cable head in the event the tool string becomes stuck in the wellbore, while maintaining the hydraulic integrity of the cable head.

DESCRIPTION OF THE PREFERRED EMBODIMENT

Figure 1:
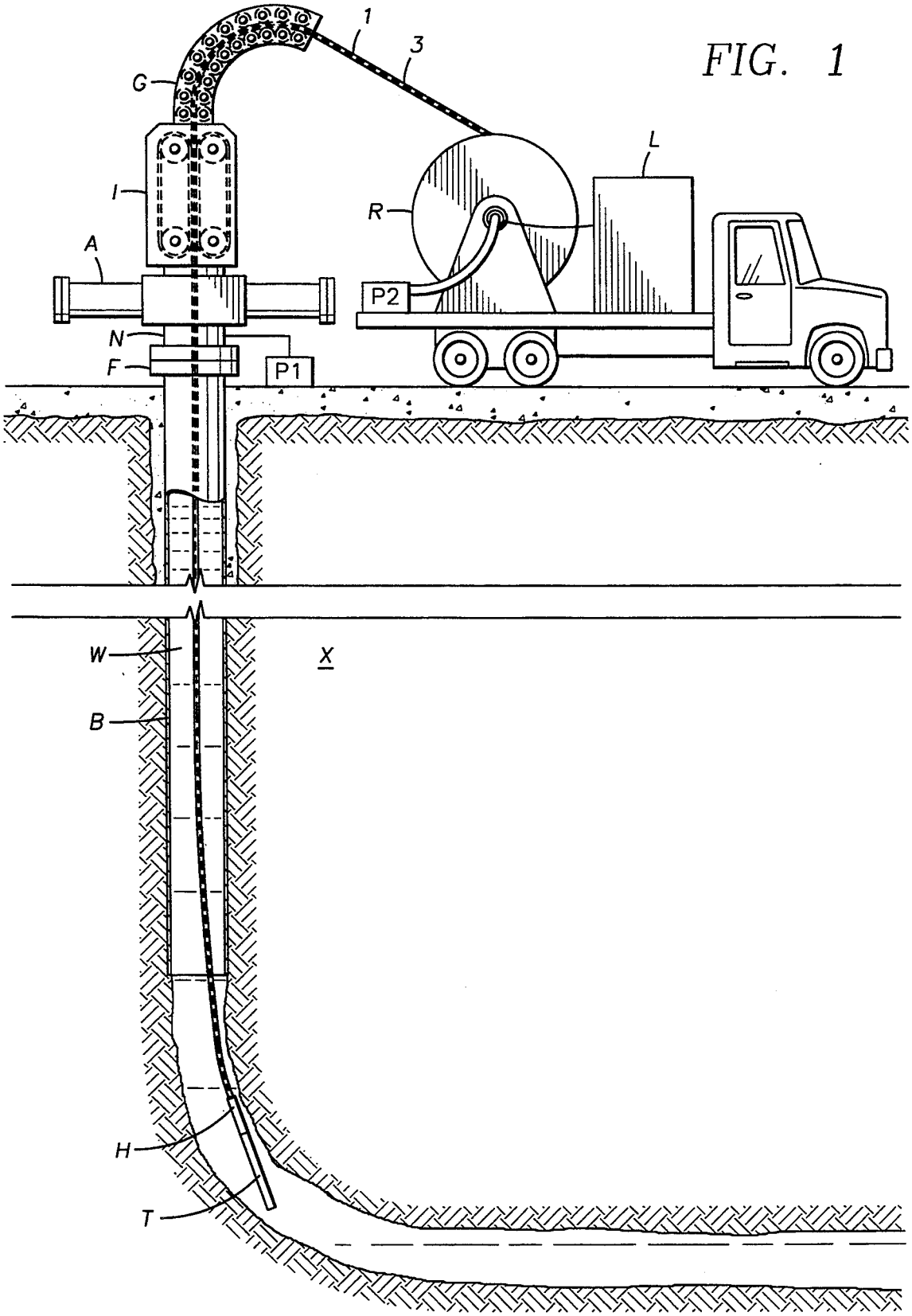
FIG. 1 shows the invention as it is typically used.

FIG. 1 shows the invention as it is typically used. A wellbore W penetrates an earth formation X. The wellbore W is equipped with a casing B having a casing flange F at the earth's surface. The wellbore W may be drilled to a greater depth than the depth of the casing B. An annular seal and ram assembly A is affixed to the flange F. Coiled tubing 1 is supplied from a reel R, and is conveyed into the wellbore W by means of a tubing injector I and guide rollers G. The coiled tubing 1 has a wireline or cable 3 coaxially inserted through the entire length of tubing 1. The cable 3 is connected to a surface logging unit L which acquires and processes data from a tool string T attached to the other end of the coiled tubing 1 by means of the invention, the cable head H. The coiled tubing 1 is connected to a first pump P2 at the earth's surface for circulating fluids needed for servicing the wellbore W. A second pump P1 can be connected to a pump in nipple N which forms part of the annular seal and ram assembly A for pumping dense fluid into the wellbore W to control fluid pressure in the wellbore W.

If the coiled tubing 1 were to develop a leak above the annular seal A, fluid could enter into the tubing 1 from the earth formation X if the fluid pressure in the earth formation X exceeds the fluid pressure in the wellbore W. The present invention, cable head H, stops fluid entry into tubing 1 until the pressure in the wellbore W can be controlled by pumping of high density fluids through either or both pumps P1 and pump P2.

Figure 2A:
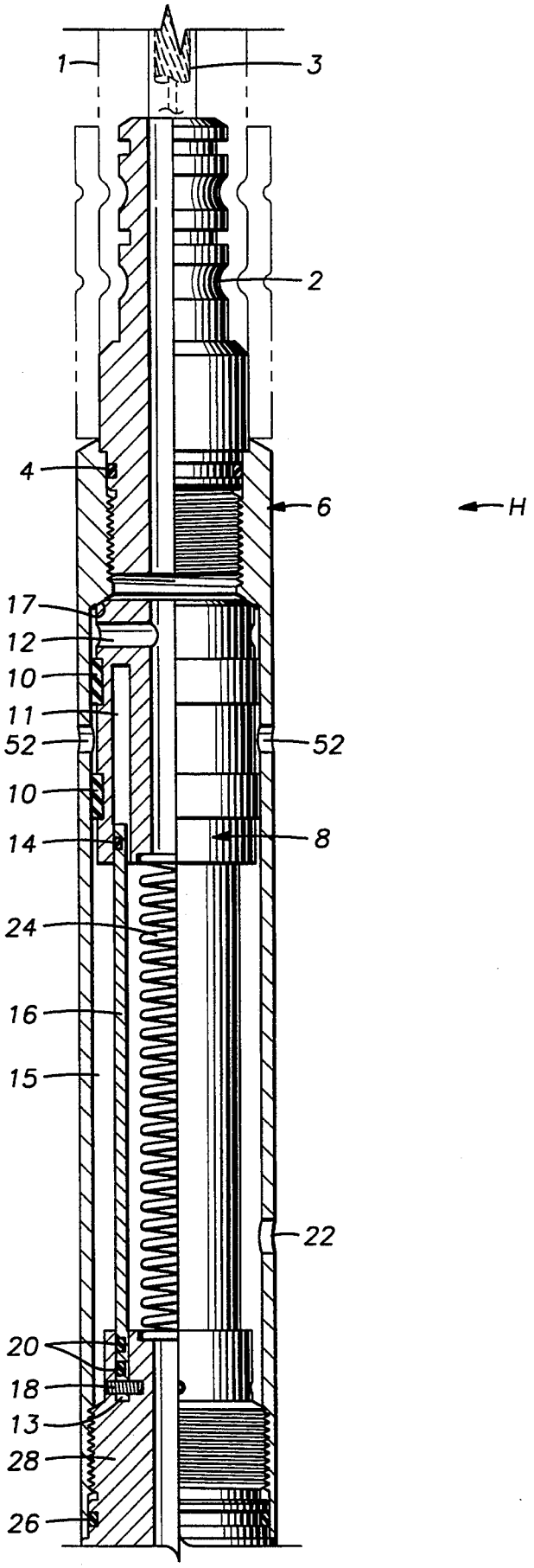
FIGS. 2A and 2B show the invention in detail.
Figure 2B:
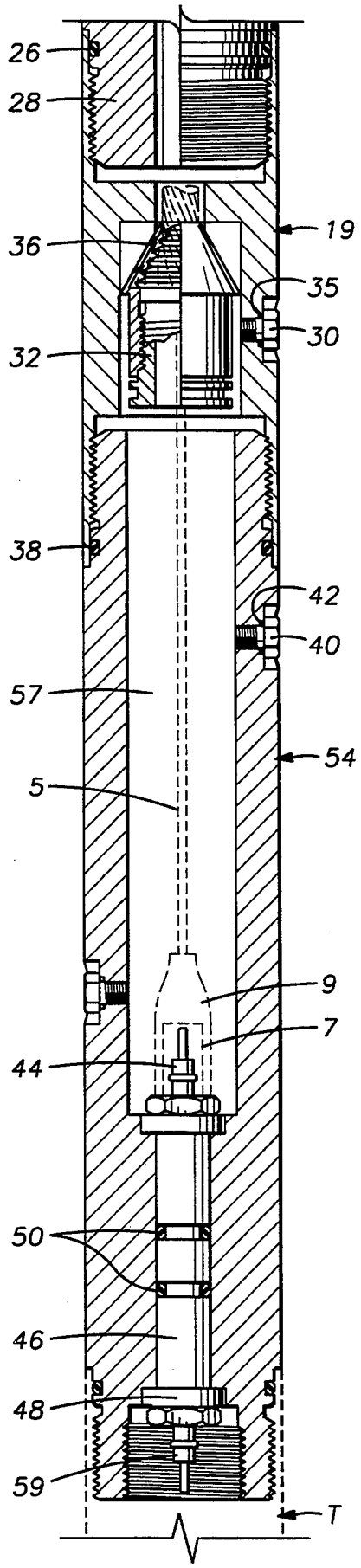

FIGS. 2A and 2B show the invention in detail. The coiled tubing 1 is affixed at one end to one end of a roll-on connector 2 located at the top of the cable head H. The roll-on connector is known in the art, and provides a mechanical connection from the tubing 1 to the cable head H, and provides an hydraulic seal to the cable head H from the tubing 1. The other end of the roll-on connector 2 is threadedly attached to a piston housing 6, and is sealed at the connection by a first o-ring 4. A piston 8 is slideably mounted inside the piston housing 6. The piston 8 is bored in the center to an internal diameter larger than the cable 3 external diameter, to enable passage of the cable 3 through the piston 8. Ports 12 are machined in the upper portion of the piston 8. The ports 12 enable fluid communication from the bored center of the piston 8 to the external diameter of the piston 8. Fluid communication from the ports 12 around the external diameter of the piston 8 is stopped by a flat seal 10, which seals between the piston 8 and the inner wall of the housing 6. A biasing means comprising a spring 24, contacts the lower face of the piston 8 at one end of the spring 24. The other end of the spring 24 seats on a tandem sub 28. The tandem sub 28 is threadedly attached to the bottom of the housing 6 and is sealed to the housing 6 by a second o-ring 26. The housing 6 includes discharge holes 52, located in the wall of the housing 6, which are substantially in radial alignment with the ports 12 and approximately ¼ inch below the rest position of the ports 12 in the piston 8. In the absence of fluid pressure on the upper face of the piston 8, the piston 8 is forced by the spring 24 to rest on a shoulder 17 machined in the uppermost portion of the housing 6, so that the ports 12 are located in the rest position above the discharge holes 52. The ports 12 are exposed to the inner wall of the piston housing 6, and the holes are sealed by at least a portion of the flat seal 10, so fluid cannot enter the housing 6 from the wellbore W through the holes 52.

The lower face of the piston 8 is in fluid communication with the wellbore through a substantially annular inner chamber 15. The inner chamber 15 is pressure isolated from the coiled tubing by a seal tube 16 which seats in a lower seal groove 13 machined into the tandem sub 28. The tube 16 is sealed externally to the tandem sub 28 by a set of o-rings 20, and can be locked into the tandem sub 28 by a snap ring 18. The other end of the tube 16 slides in an inner seal groove 11 machined into the lower face of the piston 8. The tube 16 is externally sealed to the inner seal groove 11 by a third o-ring 14. The tube 16 bounds the internal diameter of the inner chamber 15. The chamber 15 is bounded on the outer diameter by the wall of the housing 6. The inner chamber 15 is bounded at one end by the tandem sub 28, and at the other end by the piston 8. The inner chamber 15 is in fluid communication with the wellbore W through an equalization port 22 in the wall of the housing 6.

Figure 3:
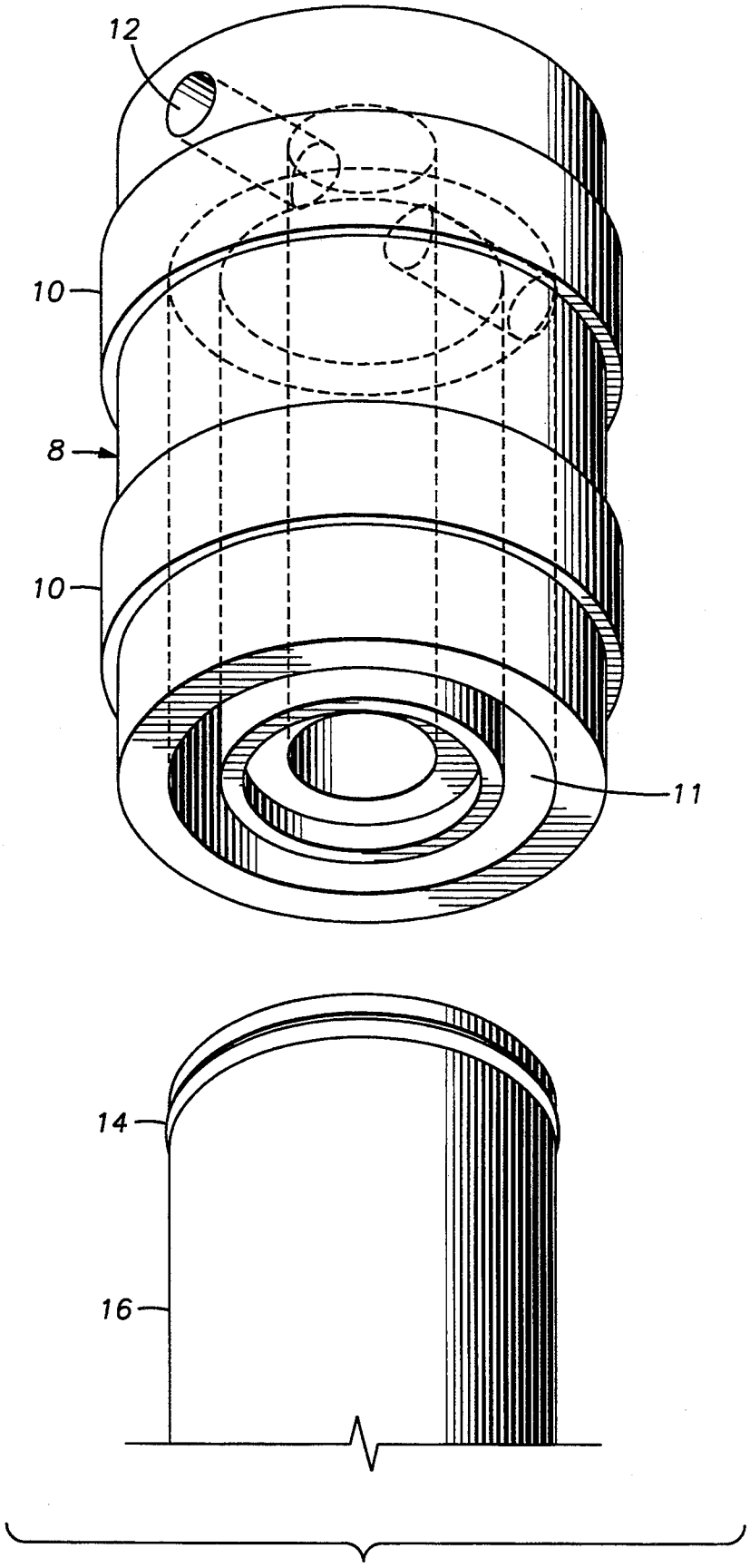
FIG. 3 shows in greater detail a piston internally sealed on its lower face by a seal tube.

Assembly of the piston 8 and the seal tube 16 can be better understood by viewing of FIG. 3. The tube 16 is externally sealed to the piston by the third o-ring 14. The inside of the tube 16 is therefore in fluid communication with the inside of the piston 8. The elongated seal groove 11 in the piston 8 enables movement of the piston 8 along the seal tube while maintaining a fluid seal from inside to outside the tube 16 and the piston 8.

Referring back to FIG. 2, fluid pressure inside the coiled tubing 1, which can be a combination of hydrostatic pressure exerted by a fluid inside the coiled tubing and pressure from the pump (shown as P2 in FIG. 1), is applied to the face of the piston 8 resting on the shoulder 17. If the fluid pressure inside the tubing 1 is greater than the fluid pressure outside the tubing 1, the force exerted on the face of the piston 8 by the pressure inside the tubing 1 will begin to move the piston 8 against the pressure exerted by the spring 24 and the fluid pressure in the chamber 15, which is the pressure inside the wellbore W. If the pressure inside the tubing 1 is sufficient to overcome the total resistance of the pressure in the wellbore W and the force of the spring 24, the piston 8 will move until the piston ports 12 align with the discharge holes 52 in the housing 6, thereby enabling fluid to circulate from inside the tubing 1 to the wellbore W. The spring 24 can be selected with a desired amount of force to provide a selected minimum amount of differential fluid pressure, between the tubing 1 and the wellbore W, required to enable fluid circulation. The minimum differential pressure enables the tubing 1 to be run into the wellbore W filled with a denser fluid than may be present in the wellbore W. If the pressure in the wellbore W exceeds the pressure in the tubing 1, the piston 8 will be forced by the fluid pressure in the chamber 15 so as to put the ports 12 out of alignment with the discharge holes 52, thereby interrupting fluid communication between the tubing 1 and the wellbore W. Because the flat seal 10 slides past the discharge holes 52 as the piston 8 moves toward the shoulder 17, the flat seal 10 acts to scrape away any materials that may deposit on the surface of the holes 52, which provides more positive sealing than the ball type check valve known in the art.

The lower portion of the cable head H provides positive fluid pressure seal if the cable 3 is extracted from the cable head H. The lower portion of the cable head H comprises a weak-point sub 19 which is threadedly connected to the lower end of the tandem sub 28, and is sealed to the tandem sub 28 by a fourth o-ring 26A. The weak point sub 19 is sealingly threadedly attached to a bulkhead housing 54. The bulkhead housing 54 forms the lowermost connection on the cable head H, which forms the mechanical and electrical connections to the tool string T.

Inside the weak-point sub 19, the cable 3 is connected to a cone and cone basket assembly 32. The assembly 32 seats on a cone seat 36 machined into the upper surface inside the weak-point sub 19. Tension which may be applied to the cable 3 during operation is transferred to the cable head H through the assembly 32, in the weak-point sub 19. The assembly 32 is calibrated to break at a predetermined applied tension, which enables recovery of the cable 3 by an appropriate pulling force on the cable 3 from the logging unit, shown as L in FIG. 1, if the tool string, shown as T in FIG. 1, should become stuck in the wellbore W.

Rotation of the cable 3 must be prevented below the assembly 32 to prevent damage to at least one cable conductor 5 which extends past the cone basket assembly 32. Rotation can be caused by tension applied to the cable 3 during operation, because the cable 3 is constructed with spirally wound external armor wires which tend to unwind when tension is applied to the cable 3. To prevent rotation, the assembly 32 is locked in place by a set screw 30 which contacts the assembly 32 radially through the wall of the weak point sub 19. The set screw 30 is sealed with a fifth o-ring 35 to prevent fluid entry into the sub 19 from the wellbore W.

The conductor 5 extends past the weak-point sub 19 into the bulkhead housing 54. The bulkhead housing 54 is threadedly attached to the weak point sub 19 and is sealed to the weak point sub 19 by a sixth o-ring 38. The bulkhead housing 54 has a connector chamber 57 which can be filled with an electrically non-conductive grease through grease fill fittings 55. The connector chamber 57 is typically filled with the grease to minimize the possibility of electrical insulation leaks from the conductor 5 to the cable head H caused by fluid in the tubing or wellbore contacting the conductor 5. After filling the chamber 57 with grease, the fittings 55 are sealed by inserting cap screws 40 which are sealed with o-rings 42. The lower end of the housing 54 is plugged with a bulkhead 46. The bulkhead 46 comprises a pressure sealed electrical feed through 44. The cable conductor 5 is attached to a crimp connector 7 which connects to the electrical feed through 44 on the bulkhead 46. The connector 7 is sealed to the bulkhead 46 by a boot 9 which attaches to the exterior of the connector 7, and to the exterior surface of the feed through 44. The bulkhead 46 is sealed to the housing 54 by o-rings 50, and is held in place by a lock-ring 48. An electrical terminal 59 on the bulkhead 46 can be connected directly to a matching electrical connector at the top of the tool string T.

Because the entire lower section of the cable head H is hydraulically sealed from the wellbore W, fluid cannot flow from the wellbore W into the coiled tubing 1 even if the cable is extracted from the cable head H by breaking the weak point.

I claim:

1. An electric wireline cable head, adapted to be conveyed by a coiled tubing having a coaxially inserted cable, into a wellbore penetrating an earth formation, said cable head comprising an apparatus for enabling fluid flow from the interior of said coiled tubing into said wellbore and for preventing fluid flow from said wellbore into the interior of said coiled tubing, said apparatus comprising:

a housing affixed to said cable head, said housing having at least one fluid discharge hole in fluid communication with said wellbore;

a piston, slideably mounted within said housing, said piston at one end in fluid communication with the interior of said coiled tubing and at the other end in fluid communication with said wellbore; and biasing means, for forcing said piston against fluid flow from the interior of said coiled tubing, so that a fluid having a pressure which exceeds the sum of the pressure within said wellbore and the pressure exerted by said biasing means against said piston, pumped into said coiled tubing, causes said piston to move, causing said at least one fluid discharge hole to be in fluid communication with said wellbore, thereby enabling fluid flow from said coiled tubing into said wellbore.

2. The apparatus as defined in claim 1 wherein said cable head further comprises a bulkhead, sealingly attached to one end of said cable head, said bulkhead maintaining the hydraulic integrity of said cable head after disengagement of said cable from said cable head.

3. The apparatus as defined in claim 1 wherein said biasing means comprises a spring having a preselected tension, said preselected tension determining a minimum differential pressure between the interior of said coiled tubing and said wellbore for establishing fluid flow from said coiled tubing into said wellbore.

4. The apparatus as defined in claim 1 wherein said piston comprises:

a flat seal enabling said piston to substantially seal said at least one fluid discharge hole;

a bore substantially in the center of said piston whereby said cable traverses said bore, said bore being in fluid communication with the interior of said coiled tubing; and at least one port connecting said bore to the external diameter of said piston whereby said bore is placed in fluid communication with said at least one fluid discharge hole by moving said piston axially so as to align said at least one hole with said at least one port.

* * * * *